United States Patent [19]

Dey

[11] Patent Number: 4,882,569

[45] Date of Patent: Nov. 21, 1989

[54] DEACTIVATABLE FEQUENCY-DIVIDING-TRANSPONDER TAG

[75] Inventor: Subrata Dey, St. Petersburg, Fla.

[73] Assignee: Security Tag Systems, Inc., St. Petersburg, Fla.

[21] Appl. No.: 224,326

[22] Filed: Jul. 26, 1988

[51] Int. Cl.[4] ..... G08B 13/26

[52] U.S. Cl. ..... 340/572; 340/551

[58] Field of Search ..... 340/551, 572

[56] References Cited

U.S. PATENT DOCUMENTS

| | | | |
|---|---|---|---|
| 4,510,489 | 4/1985 | Anderson, III et al. | 340/551 |
| 4,510,490 | 4/1985 | Anderson, III et al. | 340/551 |
| 4,622,543 | 11/1986 | Anderson, III et al. | 340/551 |
| 4,727,360 | 2/1988 | Ferguson et al. | 340/572 |
| 4,799,045 | 1/1989 | Fearon et al. | 340/551 |

*Primary Examiner*—Joseph A. Orsino
*Assistant Examiner*—Hollis Chen
*Attorney, Agent, or Firm*—Edward W. Callan

[57] ABSTRACT

A presence-detection-system tag in which a frequency-dividing transponder may be decisively deactivated notwithstanding the intensity of the ambient magnetic field. The tag includes a frequency-dividing transponder including an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency; a first bias strip of magnetic material disposed in relation to the active strip of magnetic material for biasing the active strip of magnetic material to be within the predetermined magnetic field intensity range only when the first bias strip of magnetic material is magnetized; and a second bias strip of magnetic material disposed in relation to the active strip of magnetic material for further biasing the active strip to be outside of the predetermined magnetic field intensity range to thereby prevent the active strip of magnetic material from radiating electromagnetic radiation of the second predetermined frequency in response to excitation by electromagnetic radiation of the first predetermined frequency when the first and second bias strips of magnetic material are both magnetized. A coded tag includes two such active strips having different magnetomechanical resonant frequencies. Either tag may be detected in a presence detection system that includes means for transmitting an electromagnetic radiation signal of a first predetermined frequency into a surveillance zone; and means for detecting electromagnetic radiation of the second predetermined frequency within the surveillance zone. The system further includes a magnetizer for magnetizing the second bias strip to thereby deactivate the frequency-dividing transponder of the tag.

11 Claims, 1 Drawing Sheet

DEACTIVATABLE FEQUENCY-DIVIDING-TRANSPONDER TAG

BACKGROUND OF THE INVENTION

The present invention generally pertains to presence-detection-system tags that include frequency-dividing transponders and is particularly directed to deactivation of frequency-dividing transponders of the type that includes an active strip of magnetomechanical material that frequency divides when in the presence of a magnetic field within a predetermined magnetic field intensity range.

This type of frequency-dividing transponder is described in U.S. Pat. No. 4,727,360 to Lucian G. Ferguson and Lincoln H. Charlot, Jr., which is assigned to the assignee of the present application. The transponder described therein is contained in a presence-detection-system tag with a bias strip of magnetic material that, when magnetized, biases the strip of magnetomechanical material to be within the predetermined magnetic field intensity range so as to enable frequency division by the transponder. According to the teaching of said patent, the frequency-dividing transponder described therein is deactivated by demagnetizing the bias strip of magnetic material. However, even after the bias strip has been demagnetized, the active strip of magnetomechanical material will still frequency divide if it is in the presence of an ambient magnetic field that is within the predetermined magnetic field intensity range. In certain locations, the ambient magnetic field resulting from the Earth's magnetic field is within the predetermined magnetic field intensity range. Presence-detection-system tags containing the above-described type of frequency-dividing transponder are adapted for attachment to articles to be detected within a surveillance zone. If the ambient magnetic field within the surveillance zone is within the predetermined magnetic field intensity range, false presence detections may occur even after the bias strip has been demagnetized.

SUMMARY OF THE INVENTION

The present invention provides a presence-detection-system tag in which a frequency-dividing transponder may be decisively deactivated notwithstanding the intensity of the ambient magnetic field. The tag of the present invention includes a frequency-dividing transponder including an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency; a first bias strip of magnetic material disposed in relation to the active strip of magnetic material for biasing the active strip of magnetic material to be within the predetermined magnetic field intensity range only when the first bias strip of magnetic material is magnetized; and a second bias strip of magnetic material disposed in relation to the active strip of magnetic material for further biasing the active strip to be outside of the predetermined magnetic field intensity range to thereby prevent the active strip of magnetic material from radiating electromagnetic radiation of the second predetermined frequency in response to excitation by electromagnetic radiation of the first predetermined frequency when the first and second bias strips of magnetic material are both magnetized.

The present invention further provides a presence detection system that includes means for transmitting an electromagnetic radiation signal of a first predetermined frequency into a surveillance zone; a tag as recited in the preceding paragraph; means for detecting electromagnetic radiation of the second predetermined frequency within the surveillance zone; and means for magnetizing the second bias strip to thereby deactivate the frequency dividing transponder of the tag.

Additional features of the present invention are described in relation to the description of the preferred embodiment.

DESCRIPTION OF THE PREFERRED EMBODIMENTS

Figure 1:
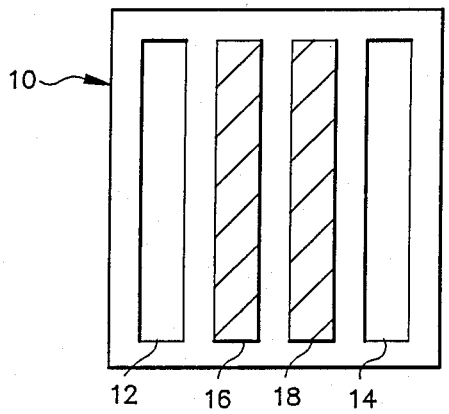
FIG. 1 illustrates a preferred embodiment of a presence-detectionsystem tag that includes a deactivatable frequency-dividing transponder.
Figure 2:
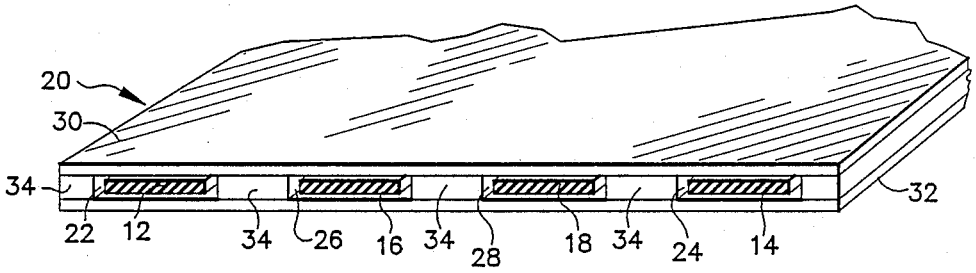
FIG. 2 shows the positioning within a housing of the components of the tag of FIG. 1.

Referring to FIGS. 1 and 2, a preferred embodiment of the tag of the present invention is a coded tag 10 including batteryless, portable first and second frequency-dividing transponders 12, 14 that frequency divide at different frequencies. The first transponder 12 is an active strip of magnetic material 12 that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency.

The second frequency-dividing transponder 14 includes a second active strip of magnetic material 14 that, when magnetically biased to be within the predetermined magnetic field intensity range, responds to excitation by electromagnetic radiation of a third predetermined frequency by radiating electromagnetic radiation of a fourth predetermined frequency that is a frequency-divided quotient of the third predetermined frequency.

The first active strip of magnetic material 12 is a thin, flat ribbon of low coercivity magnetostrictive amorphous magnetic material having a transverse uniaxial magnetic anisotropy defining a magnetomechanical resonant frequency "$f_2$" equal to one-half the first predetermined frequency in accordance with the dimensions of the ribbon, wherein when the ribbon is in the presence of a magnetic bias field within the predetermined magnetic field intensity range, the ribbon responds to the detection of electromagnetic radiation of a frequency "$2f_1$" by transmitting electromagnetic radiation of the second predetermined frequency, which is a frequency divided quotient of the frequency "$2f_1$.

The second active strip of magnetic material 14 is a thin, flat ribbon of low coercivity magnetostrictive amorphous magnetic material having a transverse uniaxial magnetic anisotropy defining a magnetomechanical resonant frequency "$f_2$" equal to one-half the third predetermined frequency in accordance with the dimensions of the ribbon, wherein when the ribbon is in the presence of a magnetic bias field within the predetermined magnetic field intensity range, the ribbon responds to the detection of electromagnetic radiation of a frequency "$2f_2$" by transmitting electromagnetic radiation of the fourth predetermined frequency, which is a frequency divided quotient of the frequency "$2f_2$.

When both the first and second active strips are of the same magnetic material, they are of different dimensions in order to define different magnetomechanical resonant frequencies $f_1$, $f_2$.

Suitable low coercivity magnetostrictive amorphous magnetic materials and the treatment and dimensioning thereof for making them useful as the active strips 12, 14 are described in the aforementioned U.S. Pat. No. 4,727,360.

The tag 10 further includes first and second bias strips of magnetic material 16, 18. Both bias strips 16, 18 are positioned in the same plane as the two active strips 12, 14 and are located between the two active strips 12, 14, with all four strips 12, 14, 16, 18 being oriented in the same direction.

The first bias strip of magnetic material 16 is disposed in relation to the first and second active strips of magnetic material 12, 14 for biasing the first and second active strips of magnetic material to be within the predetermined magnetic field intensity range when the first bias strip of magnetic material 16 is magnetized.

The second bias strip of magnetic material 18 is disposed in relation to the first and second active strips of magnetic material 12, 14 for further biasing the first and second active strips to be outside of the predetermined magnetic field intensity range to thereby prevent the first and second active strips of magnetic material 12, 14 from respectively radiating electromagnetic radiation of the second and fourth predetermined frequencies in response to excitation by electromagnetic radiation of the first and second predetermined frequencies when the first and second bias strips of magnetic material 16, 18 are both magnetized.

The first and second bias strips 16, 18 have different magnetic properties and dimensions so that the first strip 16 can be magnetized to activate the first and second transponders 12, 14, without magnetizing the second strip 18.

During the process of manufacturing the tag 10, the first bias strip 16 is magnetized by passing it over a permanent magnet. The dimensions of the permanent magnet are so chosen that the second bias strip 18 is not magnetically affected. Normally the width of the permanent magnet is controlled to assure that the second bias strip 18 is not magnetically affected.

A suitable material for the first bias strip of magnetic material 16 is 0.65 to 1.0 percent carbon steel ribbon with $B_r$=900 gauss and 2 to 5 mils thick. A suitable material for the second bias strip of magnetic material 18 is Arnokrome3 (which is available from Arnold Engineering) with $B_r$=10,500 gauss (minimum) and 9 mils thick. The first and second bias strips 16, 18 may be of the same width and length.

Referring to FIG. 2, the tag 10 includes a housing 20 defining cavities 22 and 24 for containing the first and second active strips 12, 14 and cavities 26 and 28 for containing the first and second bias strips 16, 18.

The housing 20 includes a paper cover 30, a paper base 32 and paper spacers 34. The active strips 12, 14 must be able to vibrate freely inside the housing cavities 22, 24 without interference of restriction, and must have no mechanical stress impressed on them from the walls of their respective cavities 22, 24. An exception to this requirement might be to fix each bias strip 12, 14 with a bead of silicone adhesive at its center nodal point. The dimensions of the cavities 22, 24 need only b slightly larger than the dimensions of the respective active strips 12, 14. The bias strips 16, 18 do not need to move freely and can be attached directly to the housing 20 with adhesives or sandwiched between the layers 30, 32 of the housing 20.

The active strips 12, 14 of the first and second transponders 12, 14 are both activated to enable frequency division by permanently magnetizing the first bias strip 16.

Figure 3:
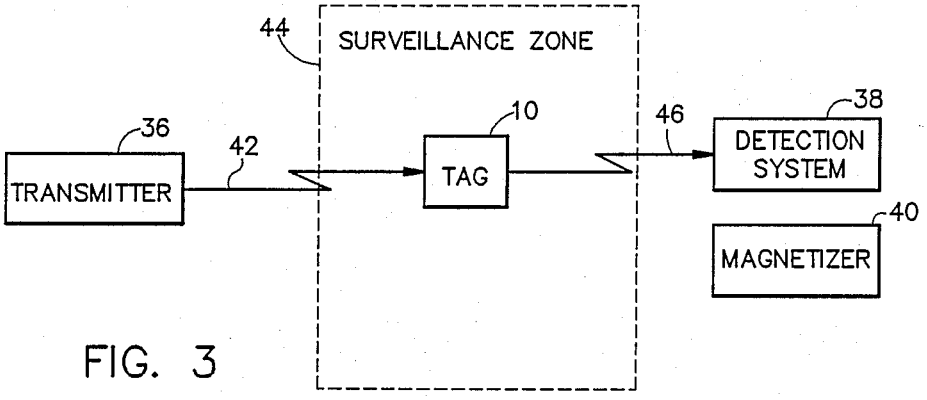
FIG. 3 is a diagram of a presence detection system including a deactivatable frequency-dividing-transponder tag according to the present invention.

The tag 10 is used in the presence detection system of FIG. 3. This system includes the tag 10, a transmitter 36, a detection system 38 and a magnetizer 40. Different combinations of active strips 12, 14 having different combinations of magnetomechanical resonant frequencies are included in different tags to thereby provide uniquely coded tags 10. The transmitter 36 provides a transmitted signal 42 into a surveillance zone 44. The transmitted signal 42 is swept over a predetermined range of frequencies that includes each of the frequencies that are twice the characteristic magnetomechanical resonant frequency of each of the active strips 12, 14; and the detection system 38 detects electromagnetic signals 46 at the characteristic resonant frequencies of the first and second active strips 12, 14 to thereby detect the presence of the tag 10 in the surveillance zone 44.

In an alternative embodiment, the detection system 38 detects acoustic waves at the characteristic magnetomechanical resonant frequencies of the first and second active strips 12, 14 to thereby detect the presence of the tag in the surveillance zone 44.

To deactivate the transponders 12, 14, the tag is subjected to the magnetizer 40, which permanently magnetizes the second bias strip 18 to further bias the active strips 12, 14 to be outside of the predetermined magnetic field intensity range to thereby prevent the active strips of magnetic material 12, 14 from radiating electromagnetic radiation at their characteristic magnetomechanical resonant frequencies in response to excitation by electromagnetic radiation at twice such resonant frequencies when the first and second bias strips of magnetic material 16, 18 are both magnetized.

After both the first and second bias strips 16, 18 have been magnetized, the tag 10 can be reactivated to operate in its frequency dividing mode by demagnetizing both of the first and second bias strips 16, 18, and then remagnetizing only the first bias strip 18. This can be accomplished by using a demagnetizing device that has a demagnetizing coil positioned so that it will demagnetize only the second bias strip 18 when the tag 10 is inserted into the demagnetizing device.

The present invention is also applicable to an uncoded tag having a single transponder including a single active strip of magnetic material 12 in combination with the first and second bias strips of magnetic material 16, 18.

I claim:

1. A tag for attachment to an article to be detected within a surveillance zone, comprising a frequency-dividing transponder including an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency, a first bias strip for magnetic material disposed in relation to the active strip of magnetic material for biasing the active strip of magnetic material to be within the predetermined magnetic field intensity range only when the first bias strip of magnetic material is magnetized; and a second bias strip of magnetic material disposed in relation to the active strip of magnetic material for further biasing the active strip to be outside of the predetermined magnetic field intensity range to thereby prevent the active strip of magnetic material from radiating electromagnetic radiation of the second predetermined frequency in response to excitation by electromagnetic radiation of the first predetermined frequency when the first and second bias strip of magnetic material are both magnetized.

2. A tag according to claim 1, wherein the first and second bias strip of magnetic material have different magnetic properties.

3. A tag according to claim 2, wherein the first and second bias strips of magnetic material have different dimensions.

4. A tag according to claim 1, wherein the first and second bias strips of magnetic material have different dimensions.

5. A tag according to claim 1, wherein the active strip of magnetic material is a thin, flat ribbon of low coercivity magnetostrictive amorphous magnetic material having a transverse uniaxial magnetic anisotropy defining a magnetomechanical resonant frequency "$f_1$" equal to one-half the first predetermined frequency in accordance with the dimensions of the ribbon, wherein when the ribbon is in the presence of a magnetic bias field within the predetermined magnetic field intensity range, the ribbon responds to the detection of electromagnetic radiation of a frequency "$2f_1$" by transmitting electromagnetic radiation of the second predetermined frequency, which is a frequency divided quotient of the frequency "$2f_1$.

6. A coded tag for attachment to an article to be detected within a surveillance zone, comprising a first frequency-dividing transponder including a first active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency;

a second frequency-dividing transponder including a second active strip of magnetic material that, when magnetically biased to be within the predetermined magnetic field intensity range, responds to excitation by electromagnetic radiation of a third predetermined frequency by radiating electromagnetic radiation of a fourth predetermined frequency that is a frequencydivided quotient of the third predetermined frequency;

a first bias strip of magnetic material disposed in relation to the first and second active strips of magnetic material for biasing the first and second active strips of magnetic material to be within the predetermined magnetic field intensity range when the first bias strip of magnetic material is magnetized; and a second bias strip of magnetic material disposed in relation to the first and second active strips of magnetic material for further biasing the first and second active strips to be outside of the predetermined magnetic field intensity range to thereby prevent the first and second active strips of magnetic material from respectively radiating electromagnetic radiation of the second and fourth predetermined frequencies in response to excitation by electromagnetic radiation of the first and second predetermined frequencies when the first and second bias strips of magnetic material are both magnetized.

7. A tag according to claim 6, wherein the first and second bias strips of magnetic material have different magnetic properties.

8. A tag according to claim 7, wherein the first and second bias strips of magnetic material have different dimensions.

9. A tag according to claim 6, wherein the first and second bias strips of magnetic material have different dimensions.

10. A coded tag according to claim 6, wherein the first active strip of magnetic material is a thin, flat ribbon of low coercivity magnetostrictive amorphous magnetic material having a transverse uniaxial magnetic anisotropy defining a magnetomechanical resonant frequency "$f_1$" equal to one-half the first predetermined frequency in accordance with the dimensions of the ribbon, wherein when the ribbon is in the presence of a magnetic bias field within the predetermined magnetic field intensity range, the ribbon responds to the detection of electromagnetic radiation of a frequency "$2f_1$: by transmitting electromagnetic radiation of the second predetermined frequency, which is a frequency divided quotient of the frequency "$2f_1$; and wherein the second active strip of magnetic material is a thin, flat ribbon of low coercivity magnetostrictive amorphous magnetic material having a transverse uniaxial magnetic anisotropy defining a magnetomechanical resonant frequency "$f_2$" equal to one-half the third predetermined frequency in accordance with the dimensions of the ribbon, wherein when the ribbon is in the presence of a magnetic bias field within the predetermined magnetic field intensity range, the ribbon responds to the detection of electromagnetic radiation of a frequency "$2f_2$" by transmitting electromagnetic radiation of the fourth predetermined frequency, which is a frequency divided quotient of the frequency "$2f_2$.

11. A presence detection system, comprising means for transmitting an electromagnetic radiation signal of a first predetermined frequency into a surveillance zone;

a tag for attachment to an article to be detected within the surveillance zone, comprising a frequency-dividing transponder including an active strip of magnetic material that, when magnetically biased to be within a predetermined magnetic field intensity range, responds to excitation by electromagnetic radiation of a first predetermined frequency by radiating electromagnetic radiation of a second predetermined frequency that is a frequency-divided quotient of the first predetermined frequency; a first bias strip of magnetic material disposed in relation to the active strip of magnetic material for biasing the active strip of magnetic material to be within the predetermined magnetic field intensity range only when the first bias strip of magnetic material is magnetized; and a second bias strip of magnetic material disposed in relation to the active strip of magnetic material for further biasing the active strip to be outside the predetermined magnetic field intensity range to thereby prevent the active strip of magnetic material from radiating electromagnetic radiation of the second predetermined frequency in response to excitation by electromagnetic radiation of the first predetermined frequency when the first and second bias strips of magnetic material are both magnetized.

means for detecting electromagnetic radiation of the second predetermined frequency within the surveillance zone; and means for magnetizing the second bias strip.

* * * * *

UNITED STATES PATENT AND TRADEMARK OFFICE

CERTIFICATE OF CORRECTION

PATENT NO. : 4,882,569

DATED : November 21, 1989

INVENTOR(S) : Subrata Dey

It is certified that error appears in the above-identified patent and that said Letters Patent is hereby corrected as shown below:

Column 2, line 53, ""$f_2$"" should read --"$f_1$"--.

Column 3, line 54, "900" should read --9000--.

Column 4, line 50, "18." should read --16. The tag 10 can also be reactivated by demagnetizing only the second bias strip 18.--.

Signed and Sealed this

Seventeenth Day of April, 1990

*Attest:*

HARRY F. MANBECK, JR.

*Attesting Officer*

*Commissioner of Patents and Trademarks*